US012729682B2

(12) United States Patent
Montilla Jimenez et al.

(10) Patent No.: US 12,729,682 B2
(45) Date of Patent: Sep. 8, 2026

(54) PROGRESSIVE CAVITY PUMP SYSTEM HAVING REVERSE MODE

(71) Applicant: Schlumberger Technology Corporation, Sugar Land, TX (US)

(72) Inventors: Benigno Segundo Montilla Jimenez, Sugar Land, TX (US); Kelly Woolsey, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 324 days.

(21) Appl. No.: 17/602,037

(22) PCT Filed: Apr. 9, 2020

(86) PCT No.: PCT/US2020/027373
§ 371 (c)(1),
(2) Date: Oct. 7, 2021

(87) PCT Pub. No.: WO2020/210427
PCT Pub. Date: Oct. 15, 2020

(65) Prior Publication Data

US 2022/0178368 A1 Jun. 9, 2022

Related U.S. Application Data

(60) Provisional application No. 62/831,701, filed on Apr. 9, 2019.

(51) Int. Cl.
*F04C 14/04* (2006.01)
*E21B 43/12* (2006.01)
(Continued)

(52) U.S. Cl.
CPC ..... *F04C 14/04* (2013.01); *E21B 43/126* (2013.01); *E21B 47/008* (2020.05);
(Continued)

(58) Field of Classification Search
CPC ..... F04B 15/02; F04B 47/00; F04B 47/02; F04B 47/06; F04B 49/08; F04B 49/022;
(Continued)

(56) References Cited

U.S. PATENT DOCUMENTS 6,079,491 A 6/2000 Stuebinger et al.
2005/0283277 A1* 12/2005 Schulz ..... E21B 43/126 700/282

(Continued)

FOREIGN PATENT DOCUMENTS

CN 203377832 U * 1/2014 ..... H02P 21/00
EP 2744980 A1 6/2014

OTHER PUBLICATIONS

Author: Exceed Oilfield Equipment Title: EHT—The ultimate PCP Rod Solution Date published (mm/yyyy): Apr. 2014 Date accessed (mm/dd/yyyy): Oct. 24, 2023 Link: https://dokumen.tips/download/link/eht-ial-force-the-rod-string-which-consist-of-sucker-rod-and-couplings.html (Year: 2014).*

(Continued)

*Primary Examiner* — Bryan M Lettman
*Assistant Examiner* — Chirag Jariwala
(74) *Attorney, Agent, or Firm* — Kyle R. Miiller

(57) ABSTRACT

A progressive cavity pump (PCP) system includes a PCP with a rotor rotatably disposed in a stator, a permanent magnet motor, sucker rod(s), and a control system. The rotor is coupled to one of the sucker rods via a high-torque connection that allows for counter clockwise rotation without loosening the connection between the rotor and sucker rod. The control system operates the system in a production mode by rotating the rotor clockwise. Upon manual input by a user, or automatic triggering when protections settings of the control system call for a shutdown or cleanout or when the control system senses an imminent pump shutdown, the (Continued)

control system operates the system in a reverse mode by rotating the rotor counterclockwise. The reverse mode pumps fluids and suspended solid particles down into the well prior to pump shutdown to inhibit the solids from clogging the pump or preventing the pump from restarting.

14 Claims, 7 Drawing Sheets

(51) Int. Cl.

| | |
|---|---|
| ***E21B 47/008*** | (2012.01) |
| ***F04C 2/107*** | (2006.01) |
| ***F04C 13/00*** | (2006.01) |
| ***F04C 14/06*** | (2006.01) |
| ***F04C 14/08*** | (2006.01) |

(52) U.S. Cl.
CPC ..... *F04C 2/1073* (2013.01); *F04C 13/008* (2013.01); *F04C 14/06* (2013.01); *F04C 14/08* (2013.01); *F04C 2240/40* (2013.01); *F04C 2270/035* (2013.01); *F04C 2270/0525* (2013.01); *F04C 2270/18* (2013.01)

(58) Field of Classification Search
CPC .... E21B 43/126; E21B 43/128; E21B 47/008; F04C 2/1073; F04C 13/005; F04C 13/008; F04C 14/06; F04C 14/08; F04C 14/28; F04C 2240/40; F04C 2270/035; F04C 2270/0525; F04C 2270/18; F04C 2270/185; F04C 14/04; F04C 2270/03
USPC ..... 166/263
See application file for complete search history.

(56) References Cited

U.S. PATENT DOCUMENTS

| | | | | |
|---|---|---|---|---|
| 2008/0246427 | A1* | 10/2008 | Petit | F04C 15/008 318/474 |
| 2009/0223665 | A1* | 9/2009 | Colley, III | E21B 43/26 166/305.1 |
| 2013/0333893 | A1* | 12/2013 | Morris et al. | F04C 13/008 285/120.1 |
| 2016/0060968 | A1 | 3/2016 | Xie | |
| 2016/0097280 | A1 | 4/2016 | Ladron De Guevara | |
| 2016/0115959 | A1* | 4/2016 | Cheng | F04C 13/008 417/45 |
| 2017/0177761 | A1* | 6/2017 | Early et al. | E21B 41/00 |
| 2017/0373613 | A1* | 12/2017 | Duerr et al. | H02H 7/20 |
| 2018/0313349 | A1* | 11/2018 | Todal et al. | F04B 49/106 |
| 2020/0158116 | A1* | 5/2020 | Esberger et al. | F04D 15/0066 |
| 2021/0025381 | A1* | 1/2021 | Orfanoudakis | E21B 43/128 |

OTHER PUBLICATIONS

International Search Report and Written Opinion issued in the PCT Application PCT/US2020/027373 dated Jul. 22, 2021 (13 pages).

* cited by examiner

PROGRESSIVE CAVITY PUMP SYSTEM HAVING REVERSE MODE

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a national stage entry under 35 U.S.C. 371 of International Application No. PCT/US2020/027373, filed Apr. 9, 2020, which claims priority benefit of U.S. Provisional Application No. 62/831,701, filed Apr. 9, 2019, the entirety of which is incorporated by reference herein and should be considered part of this specification.

BACKGROUND

Field

The present disclosure generally relates to progressive cavity pump systems, and more particularly to systems and methods for preventing, inhibiting, or reducing the likelihood of solid materials settling on top of or in a progressive cavity pump during pump shut down.

Description of the Related Art

Oil and gas wells utilize a borehole drilled into the earth and subsequently completed with equipment to facilitate production of desired fluids from a reservoir. Subterranean fluids, such as oil, gas, and water, are often pumped or "lifted" from wellbores by the operation of downhole pumps, for example progressive cavity pumps (PCPs). A PCP includes a single external helical rotor that rotates inside a double internal helical stator. In use, fluid is displaced from the intake at the bottom of the pump to the discharge at the top through a series of cavities that form between the rotor and stator as the rotor rotates, e.g., clockwise, within the stator. A motor drives rotation of the rotor. The motor can be located at the surface of the wellbore, and may be connected to the rotor via one or more sucker rods.

SUMMARY

According to systems and methods of the present disclosure, during solids cleanout, or while performing a pump shutdown, a PCP system operates in a reverse mode, in which the rotor of the PCP rotates counter clockwise, pumping well fluids and suspended solid particles down into the well bore prior to stopping operation of the PCP.

In some configurations, a method of operating a progressive cavity pump (PCP) system including a PCP disposed in a wellbore includes operating the PCP system in a production mode and operating the PCP system in a reverse mode. In the production mode, a rotor of the PCP rotates in a first direction. In the reverse mode, the rotor rotates in a second direction opposite the first direction.

The first direction can be clockwise. The second direction can be counter clockwise.

The method can further include receiving an input from a user into a control system of the PCP system. The PCP system is operated in the reverse mode in response to the input received from the user. Additionally or alternatively, the PCP system is operated in the reverse mode in response to the control system of the PCP system automatically triggering the reverse mode.

The method can further include monitoring torque and/or discharge pressure of the PCP. The method can include stopping operation of the PCP if the torque and/or discharge pressure reaches a predetermined setpoint. The method can further include stopping operation of the PCP after operation in the reverse mode, and the reverse mode can be configured to pump fluids and/or suspended solid particles down the wellbore prior to stopping operation of the PCP.

In some configurations, a progressive cavity pump (PCP) system includes a PCP, a permanent magnet motor drive (PMM Drive or PMM), a sucker rod, and a control system configured to control operation of the PCP system. The PCP includes a rotor rotatably disposed within a hollow stator and is configured to be disposed downhole in a borehole of a well. The PMM Drive is configured to be disposed at a surface of the well. The sucker rod is connected to the rotor of the PCP via a high torque connection and operatively coupled to the PMM Drive. In use, the PMM Drive is configured to transmit power to the downhole pump and support the axial load (weight and hydraulic thrust) from the rod string, and the sucker rod is configured to rotate the rotor. The control system is configured to operate the PCP system in a production mode, in which the PMM Drive causes the rotor to rotate in a first direction, and a reverse mode, in which the PMM Drive causes the rotor to rotate in a second direction opposite the first direction.

The high torque connection can include a dovetail joint. The high torque connection can be configured to isolate axial forces on a junction of the sucker rod and the rotor from circumferential forces on the junction. The high torque connection can include a tapered projection at a lower end of the sucker rod and a corresponding recess at an upper end of the rotor. The high torque connection can include an externally threaded portion of the sucker rod, an externally threaded portion of the rotor, and an internally threaded coupling configured to threadingly engage the externally threaded portions of the sucker rod and the rotor. The threaded connection between the sucker rod and the rotor can be configured to bear axial forces on a junction of the sucker rod and the rotor, and a connection between the tapered projection of the sucker rod and the recess of the rotor can be configured to bear circumferential forces on the junction of the sucker rod and the rotor.

The control system can be configured to control backspin speed and torque when operating the PCP system in the reverse mode. The control system can include one or more user interfaces configured to receive input from a user.

The PCP system can include one or more sensors configured to monitor one or more parameters of the PCP system and/or the well. The control system can be configured to process data from the one or more sensors and determine if the PCP is approaching a run dry condition. The control system can be configured to stop operation of the PCP if the control system determines the PCP is approaching a run dry condition.

In some configurations, a control system for a progressive cavity pump (PCP) system including a PCP includes a display screen, one or more user interfaces, and a processor. The processor is configured to operate the PCP in a production mode, in which a rotor of the PCP rotates in a first direction, and operate the PCP in a reverse mode, in which the rotor rotates in a second direction opposite the first direction.

The processor can be further configured to control backspin speed and torque when operating the PCP system in the reverse mode. The processor can be further configured to determine if torque and/or discharge pressure of the PCP reaches a predetermined setpoint. The processor can be further configured to stop operation of the PCP if the torque and/or discharge pressure of the PCP reaches the predetermined setpoint.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
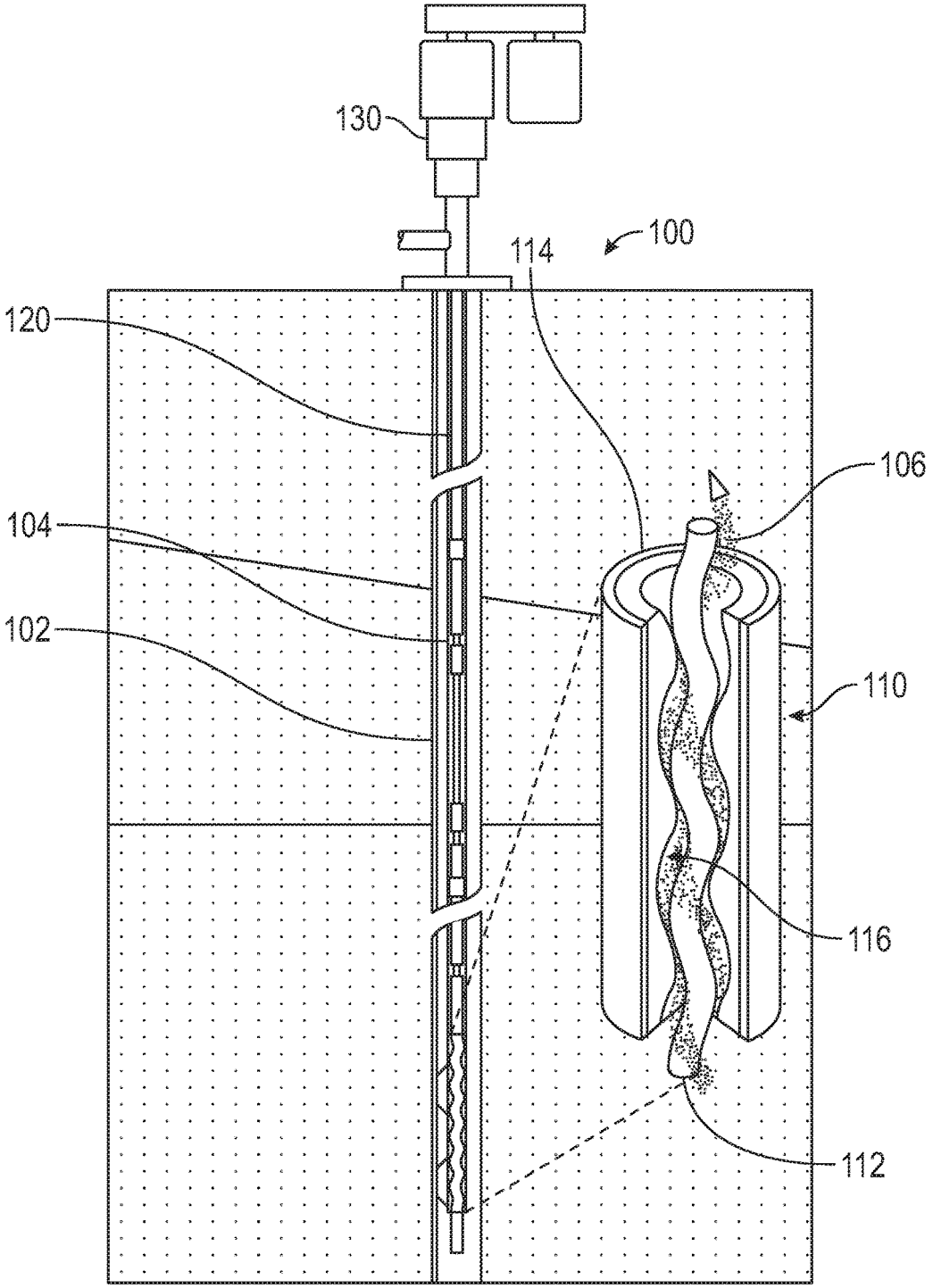
FIG. 1 illustrates an example traditional PCP system.

FIG. 1 illustrates an example PCP system 100. As shown, the PCP system 100 includes a pump (i.e., a PCP) 110, one or more sucker rods 120, and an electric motor 130. The PCP 110 includes a single external helical rotor 112 that rotates inside a double internal helical stator 114 in use. During operation, fluid 106 is transferred from an intake at the bottom of the pump 110 to a discharge or outlet at the top of the pump 110 through a series of cavities 116 that form between the rotor 112 and stator 114 as the rotor 112 rotates, e.g., clockwise, within the stator 114.

In use, the PCP 110 is disposed downhole in a borehole lined with a well casing 102. The electric motor 130 is disposed at the surface of the well. The sucker rods 120 extend between and connect (e.g., physically and/or operatively connect) surface components of the system 100, such as the electric motor 130, and downhole components of the system 100, such as the PCP 110. Each sucker rod 120 can be threaded at one or both ends to enable threaded connections with other components, such as the PCP 110 (i.e., the rotor 112), surface component(s), and/or other sucker rods 120. In use, the motor 130 rotates or causes rotation of the sucker rods 120, which in turn rotate or cause rotation of the rotor 112. Production tubing 104 can be disposed in the borehole to convey pumped fluids 106 discharged from the outlet of the PCP 110 to the surface. In the illustrated configuration, the tubing 104 is disposed around or surrounds the sucker rods 120.

PCPs are often used to recover viscous fluids, such as heavy oil, and fluids with relatively high concentrations of suspended solid particles, such as sand. If the pump is stopped or shut down during production, the solid particles can settle out of suspension and collect on the pump. Build-up of solids on the pump can clog the pump and/or prevent or inhibit the pump from restarting when desired, for example, due to friction. Additionally, during pump shut down, the pump can be driven backwards, e.g., counterclockwise, due to the downward draining and pressure of well fluids and/or solid particles. Backwards rotation of the pump can allow the solid particles to enter the pump, which can clog the pump, and/or can loosen or even allow for the disconnection of connections between a sucker rod and the pump, between a sucker rod and surface components, and/or between sucker rods.

Systems and methods as described herein advantageously allow or cause the PCP to rotate counter clockwise to pump the fluid column including solids down the wellbore prior to a pump shut down. Systems and methods as described herein can be used to prevent, inhibit, or reduce the likelihood of solid materials settling on top of or in a PCP during shut down of the pump. Systems and methods as described herein can prevent, inhibit, or reduce the likelihood of disconnection between a sucker rod and the pump, between a sucker rod and surface components, and/or between sucker rods during counter clockwise rotation.

Figure 2:
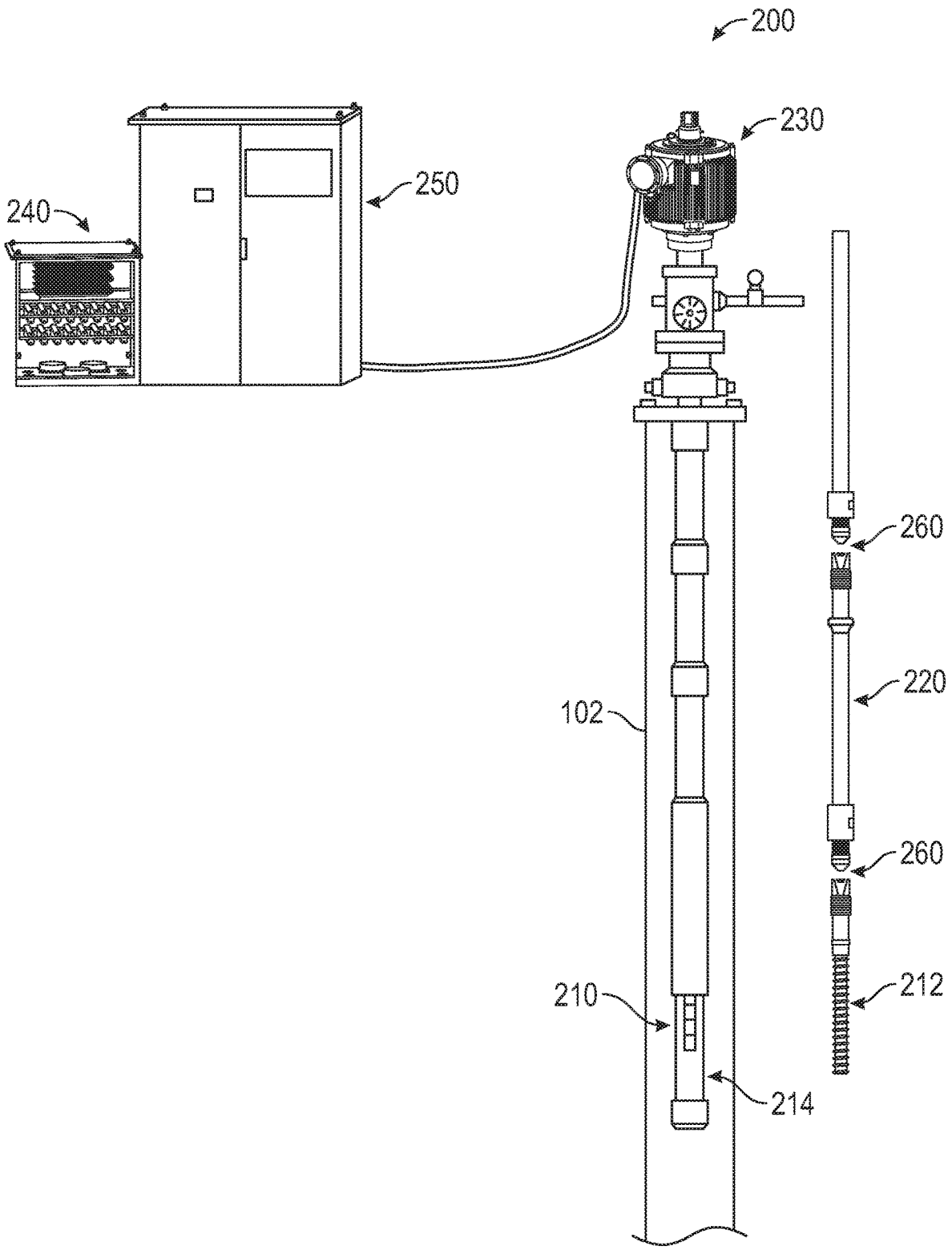
FIG. 2 illustrates an example PCP system according to embodiments of the disclosure.

An example of a PCP system 200 according to the present disclosure is shown in FIG. 2. In the illustrated configuration, the system 200 includes a PCP 210 (having a rotor 212 rotatably disposed in a stator 214), one or more sucker rods 220, a permanent magnet motor (PMM) 230, a variable-frequency drive (VFD) 240, and a well manager or control system 250. A system 200 according to the present disclosure can include any one or more of these components. In use, the PCP 210 is disposed downhole in a borehole lined with a well casing 102, The PMM 230 is disposed at the surface of the well. The sucker rods 220 extend between and connect (e.g., physically and/or operatively connect) surface components of the system 200, such as the PMM 230, and downhole components of the system 200, such as the PCP 210. In use, the PMM 230 rotates or causes rotation of the sucker rods 220, which in turn rotate or cause rotation of the rotor 212.

Figure 4:
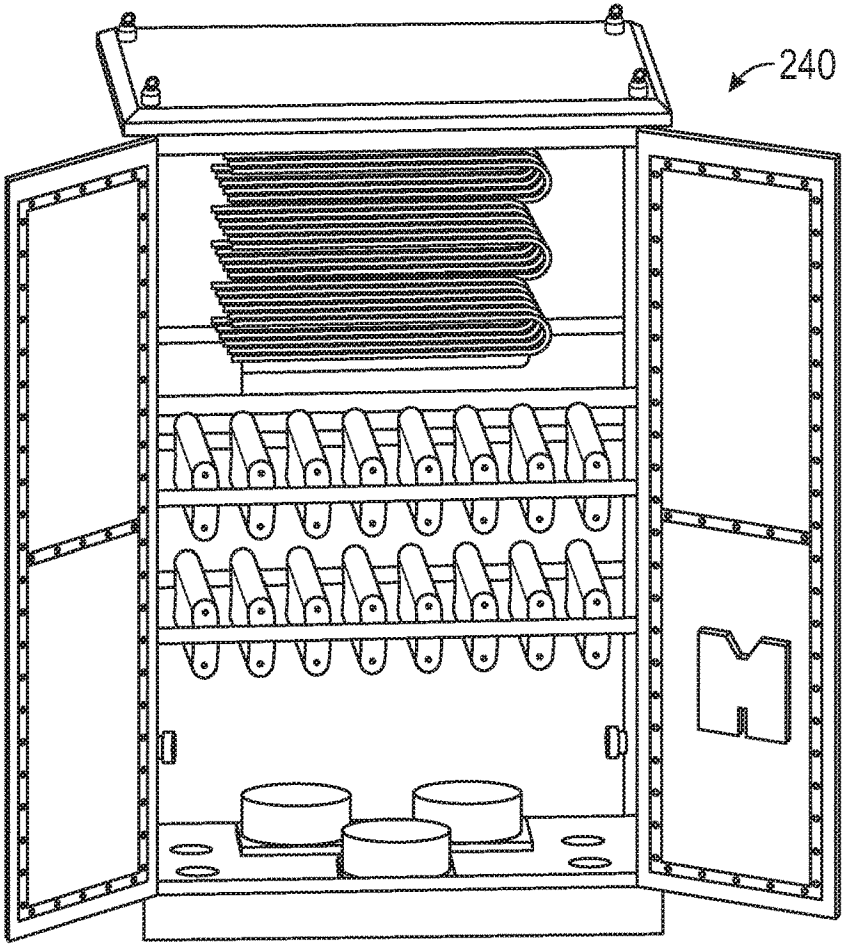
FIG. 4 illustrates an example variable frequency drive.
Figure 3:
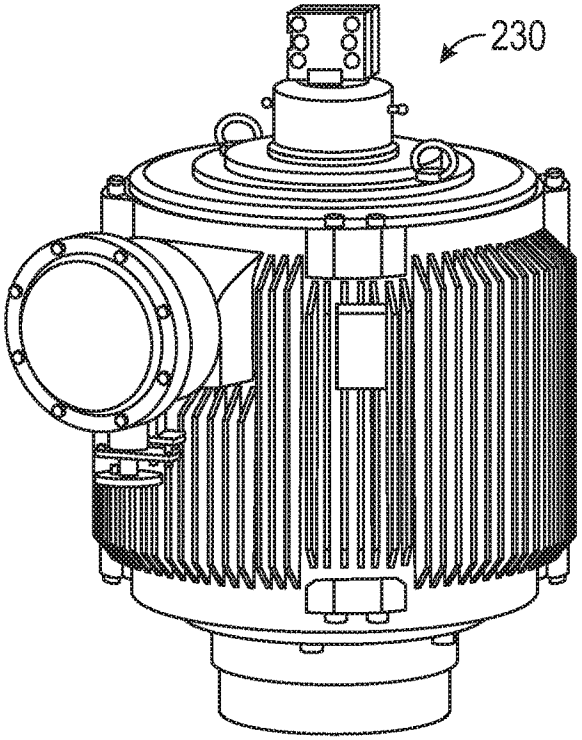
FIG. 3 illustrates an example permanent magnet motor.

A PCP system 200 according to the present disclosure includes a PMM, an example of which is shown in FIG. 3, rather than an electric motor 130 as is typically used in a traditional PCP system. A typical electric motor 130 includes a friction brake system and cannot rotate backwards, e.g., counterclockwise. A typical electric motor therefore cannot control backspin and torque. In contrast, the PMM 230 of present system 200 does not include an internal brake. Instead, the system 200 includes a VFD, an example of which is shown in FIG. 4, that applies a DC brake/AC brake to the PMM 230. Backspin and/or torque of the PMM 230 can therefore be controlled by current injected by the VFD. The PMM 230 allows the PCP 210 to be rotated backwards, e.g., counterclockwise.

The PMM 230 can also advantageously be more efficient and consume less power than an electric motor 130 in a traditional PCP system 100. For example, the PMM 230 can be up to around 97% efficient, allowing for up to around 25% less power consumption compared to an electric motor 130 in a traditional PCP system 100. The PMM 230 can therefore have a lower operating cost. The PMM 230 can be safer than an electric motor 130, for example, because the PMM 230 does not include external moving parts. The PMM 230 can advantageously operate with reduced noise and/or vibration. The PMM 230 can provide or allow for improved service life and require less preventive maintenance. The PMM 230 can provide full torque over its full speed range (for example, 25-500 RPM).

In a traditional PCP system 100 with conventional sucker rods 120, counter-clockwise rotation can loosen or disconnect connections, e.g., threaded connections, between a sucker rod 120 and the rotor 112, between a sucker rod 120 and surface components, and/or between sucker rods 120. A system 200 according to the present disclosure can include high torque connections 260 between a sucker rod 220 and the rotor 212, between a sucker rod 220 and surface components, and/or between sucker rods 220. Sucker rods 220 adapted for high torque connections 260 can provide about 20-30% higher torque compared to conventional sucker rods 120. For example, a ⅞" sucker rod 220 can provide torque up to about 1800 Nm. A 1" sucker rod 220 can provide torque up to about 2100 Nm. A 1⅛" sucker rod 220 can provide torque up to about 4100 Nm.

Figure 6:
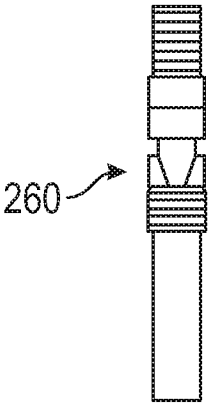
FIG. 6 illustrates a high-torque connection between the rotor and one of the sucker rods of FIG. 5.
Figure 5:
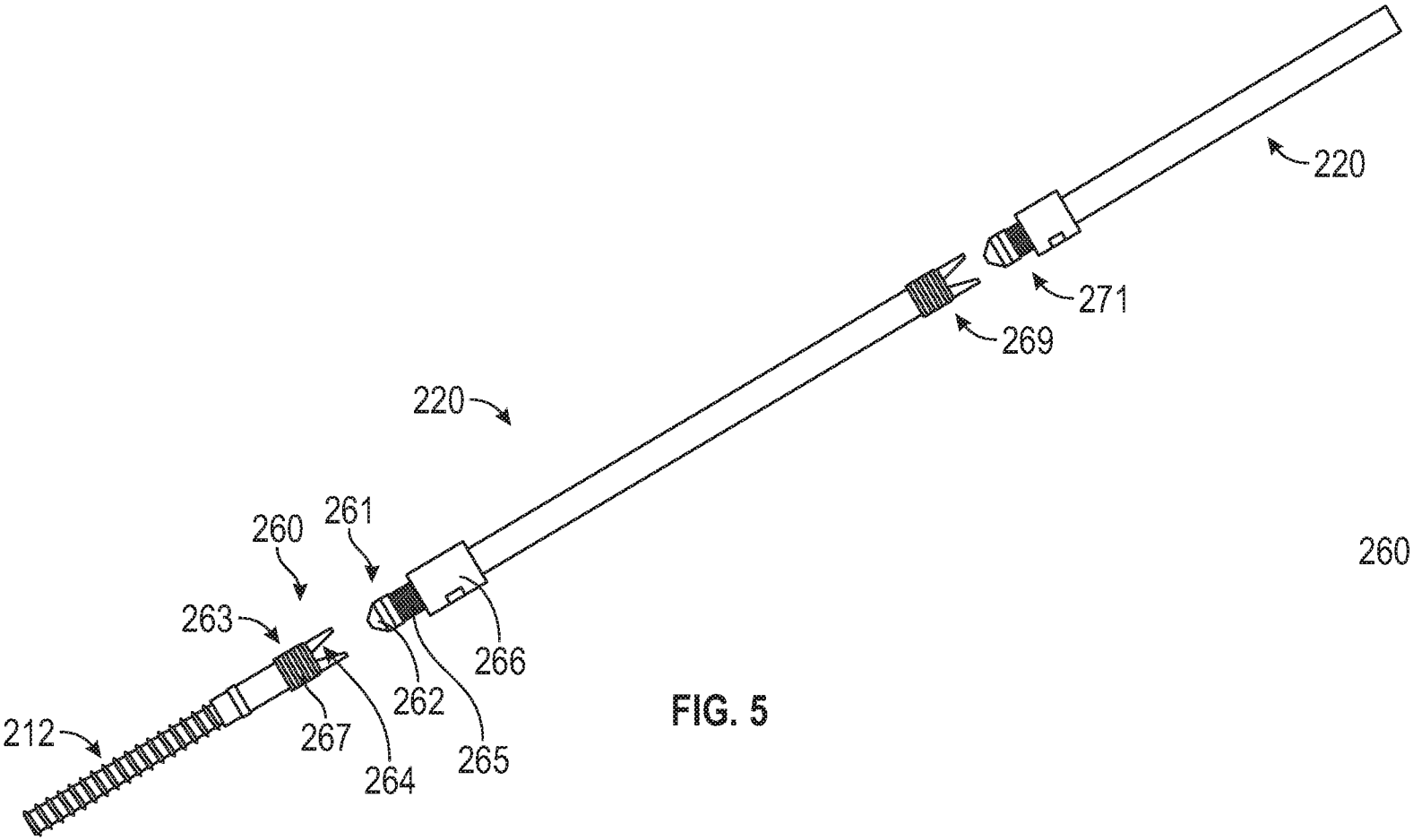
FIG. 5 illustrates an exploded view of an assembly including example sucker rods and an example rotor.

FIG. 5 illustrates examples of sucker rods 220 and a rotor 212 configured to make high torque connections 260, and FIG. 6 illustrates an example high torque connection 260. A first end, e.g., a bottom or lower end, of the sucker rod 220 includes a rod connector 261. A first end, e.g., a top or upper end, of the rotor 212 includes a rotor connector 263. The rod connector 261 couples to the rotor connector 263 to form a high torque connection 260.

In the illustrated configuration, the high torque connection 260 includes a dovetail joint. As shown, the rod connector 261 includes a tapered projection 262. The rotor connector 263 includes a corresponding recess 264. To connect the rotor 212 to the sucker rod 220, the projection 262 of the sucker rod 220 is inserted into the recess 264 of the rotor 212. In the illustrated configuration, the rod connector 261 includes an externally threaded portion 265. The rotor connector 263 includes an externally threaded portion 267. The high torque connection 260 can further include an internally threaded coupling 266. When the projection 262 of the rod connector 261 is coupled with the recess 264 of the rotor connector 263, the coupling 266 can be threaded onto the externally threaded portions 265, 267 of the rod connector 261 and rotor connector 263 such that the coupling 266 spans the sucker rod 220 and rotor 212 and circumferentially surrounds the dovetail joint.

In the illustrated configuration, a second end, e.g., a top or upper end, of the sucker rod 220 opposite the first end includes a second rod connector 269. The second rod connector 269 can include some or all of the features of the rotor connector 263 as shown. The second rod connector 269 can form a high torque connection 260 with a connector 271 of a second sucker rod 220 (as shown in the configuration of FIG. 5) or a connector of a surface component. The connector 271 of the second sucker rod 220 and/or the connector of the surface component can include some or all of the features of the rod connector 261, such that the second rod connector 269 can be coupled to the connector 271 of the second sucker rod 220 or the connector of the surface component to form a high torque connection 260.

In a traditional PCP system 100, the threaded connections between the rotor 112 and a sucker rod 120, between a sucker rod 120 and surface components, and/or between sucker rods 120 are subjected to both axial forces and stress (due to the weight of the rod string and PCP 110) and circumferential forces and stress (due to rotation of the sucker rod 120). This can increase the risk or likelihood of one or more of the threaded connections failing, particularly as traditional sucker rods 120 and connections may be designed primarily to withstand axial forces and stress and may not be designed to, or capable of, withstanding circumferential torque. The high torque connection 260 illustrated in FIGS. 5-6 advantageously separates or isolates the circumferential stress and axial stress. The threaded connections between the coupling 266 and the threaded portions 265, 267 of the rod connector 261 and rotor connector 263 bear the axial force and stress from the weight of the rod string and PCP 110, while the dovetail joint bears the circumferential torque and stress. An example of sucker rods 220 configured for high torque connections 260 including dovetail joints that can be included in a system 200 according to the present disclosure are EHT® rods available from Exceed Oilfield Equipment. However, other configurations for the high torque connections 260 are also possible, for example, other types and configurations of joints and connections that separate or isolate circumferential forces on the joints or connections from axial forces on the joints or connections.

Figure 7:
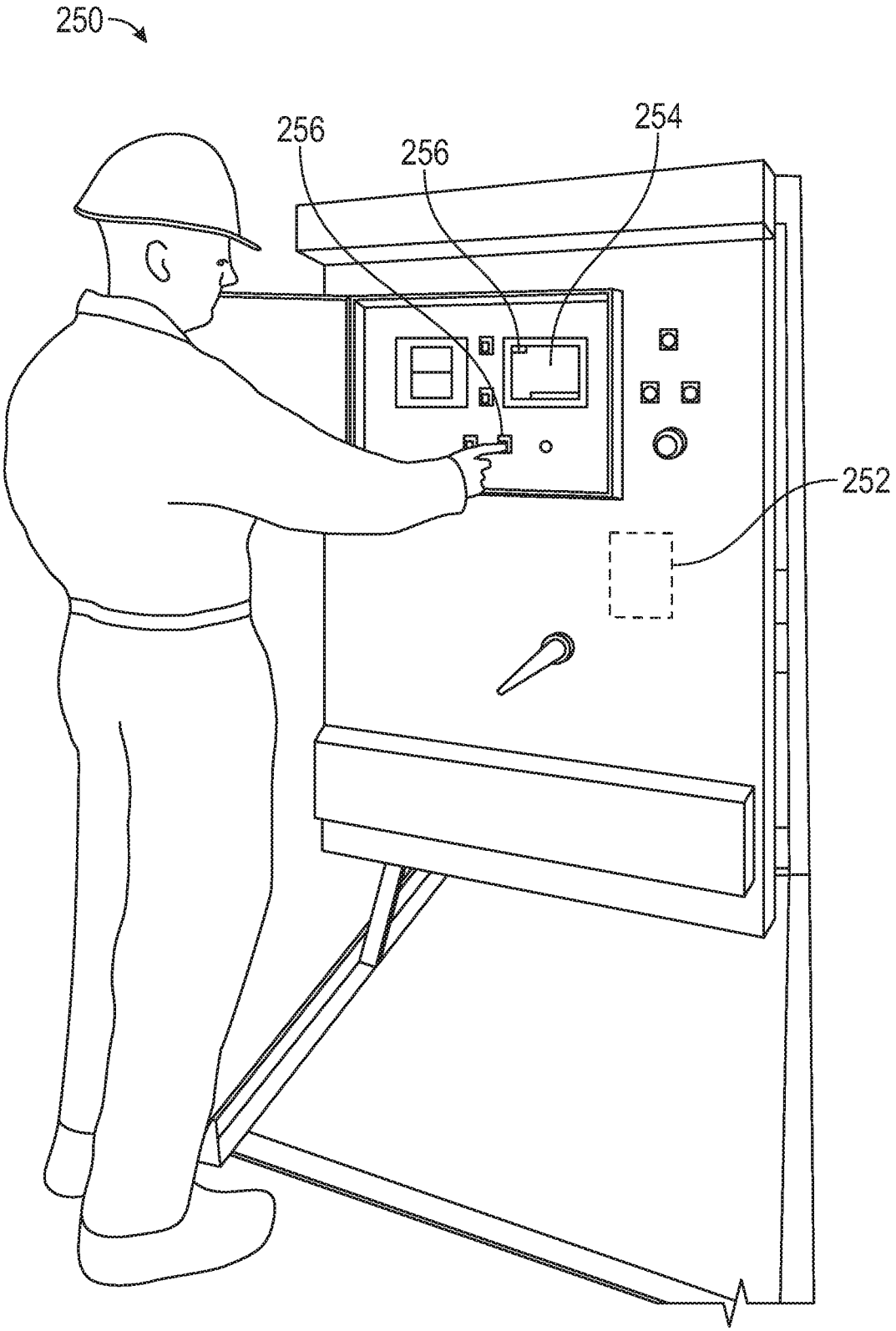
FIG. 7 illustrates an example well manager or control system.

As described herein, a PCP system 200 according to the present disclosure can include a well manager or control system 250, for example as shown in FIG. 7. The control system 250 includes a processor or controller 252 (schematically shown in FIG. 7) and one or more user interfaces 256. The control system 250 can also include a display screen 254 as shown to display various information to a user. The user interfaces 256 can include the display screen 254 (i.e., the display screen 254 can be a touch screen that can receive user input) and/or one or more buttons, switches, knobs, or the like that allow a user to provide input to the controller 252. The controller 252 controls operation of PCP system 200. For example, the controller 252 can be operatively connected to the PMM and provide signals to the PMM, for example, to start and/or stop operation of the PMM, which in turn causes the rotor 212 of the PCP 210 to start and/or stop rotating. An example well manager 250 that can be used in systems and/or methods according to the present disclosure is the KUDU PCP Manager, available from Schlumberger.

As described herein, if the PCP 210 is shut down during operation, solid particles can settle out of suspension and collect on the pump, and the pump can be driven backwards by the downward draining of the fluid column and/or build up of solid particles. In a typical PCP system, the build-up of solid particles on the pump and backwards rotation of the pump can clog the pump, prevent or inhibit the pump from restarting when desired, and/or loosen or cause disconnection of connections between the rotor and a sucker rod, between the sucker rod and surface components, and/or between sucker rods.

To avoid such problems, the controller 252 of the present disclosure is configured to operate the PCP system 200 in a production, or "normal," mode and a reverse mode. The user can manually activate the reverse mode, for example, prior to pump shut down. In some configurations, the controller 252 can automatically activate the reverse mode, for example, if the controller 252 determines a shutdown is imminent (for example, based on sensor data) or protection settings of the controller 252 call for a shutdown or cleanout. In the reverse mode, the rotor 212 is rotated backwards, e.g., counter-clockwise, to pump the fluid column above the PCP 110, including solid particles suspended therein, back down in the borehole. This can clear viscous production fluids and/or solid particles from above and/or within the PCP 210 before the PCP 210 is shut down, thereby allowing the PCP 210 to be restarted more easily when desired.

Figure 8A:
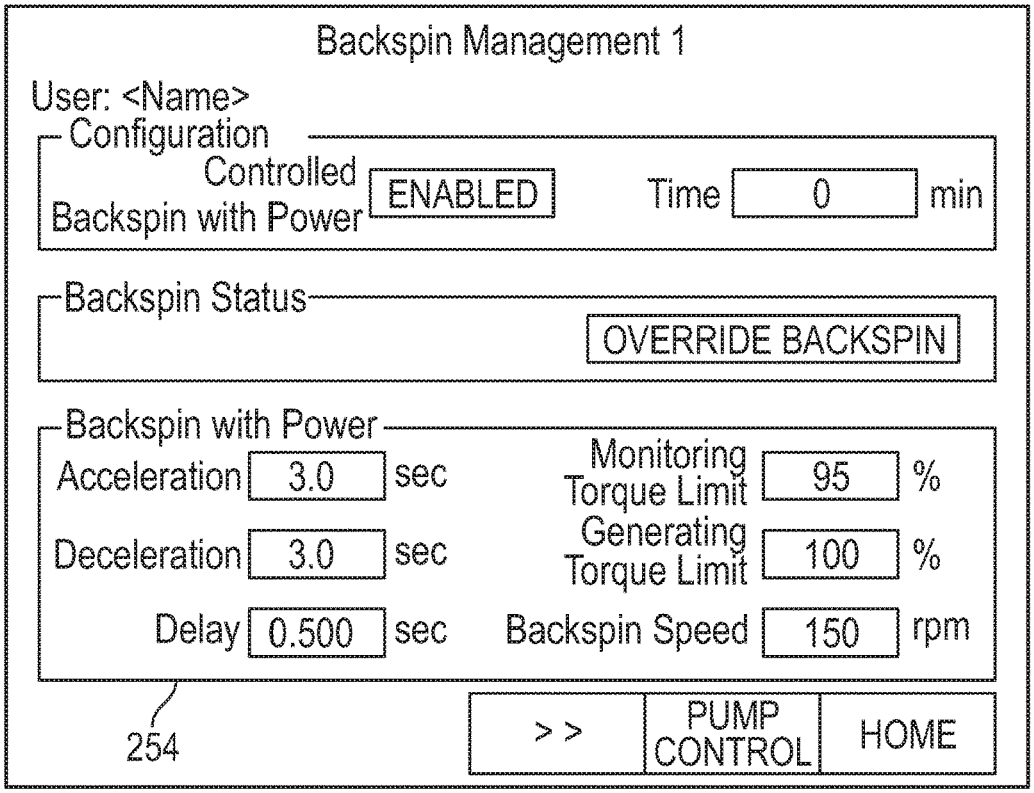
FIGS. 8A and 8B illustrate example screenshots of a user interface of the well manager or control system of FIG. 7.
Figure 8B:
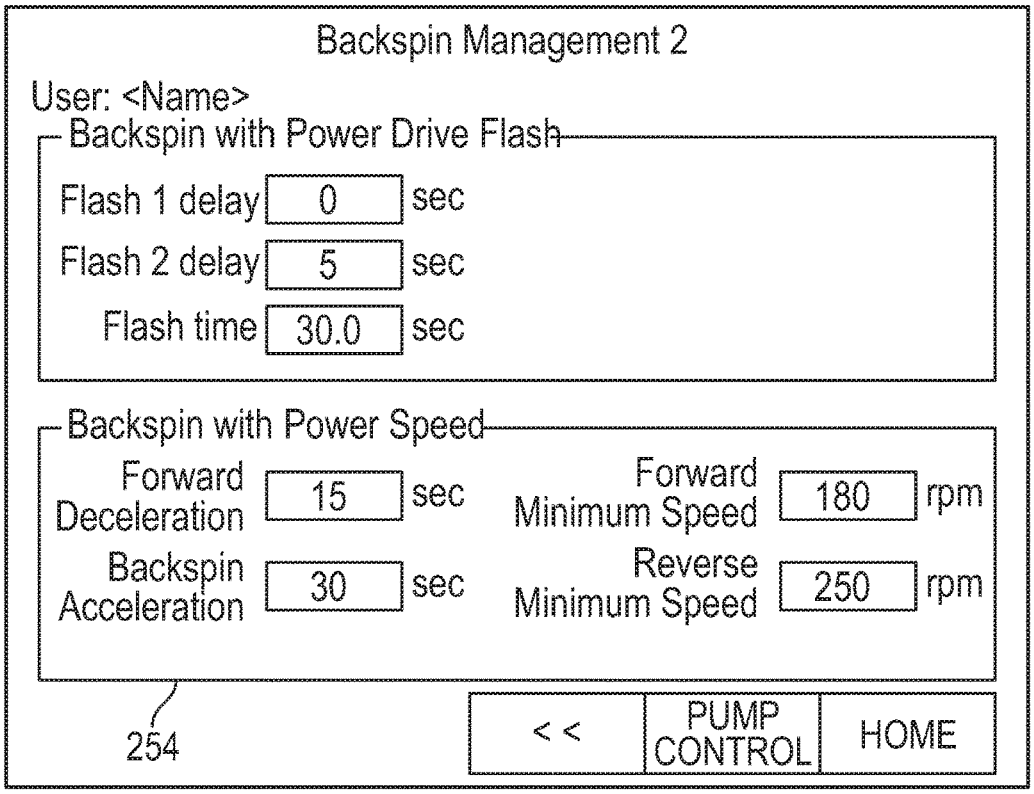

The PCP system 200 can monitor various parameters, for example, regarding the condition of the system 200 and/or the surrounding environment, during operation, for example, via data received and/or processed by the controller 252 from one or more various sensors or gauges located in the wellbore. The controller 252 can use such sensor data to control the system 200. Information regarding the monitored parameters, the current mode of operation, and/or other information can be provided to the user, for example, via the display screen 254. FIGS. 8A and 8B show screen shots of example information that can be displayed on the display screen 254 when the user is activating the reverse mode or during operation of the PCP system 200 in reverse mode.

The control system 250 includes an algorithm (for example, stored in a memory of the control system 250) that can be executed by the controller 252. In some configurations, the algorithm can automatically trigger the reverse mode, for example, when protections settings of controller 252 call for a shutdown or cleanout, or when the controller 252 senses an imminent shutdown due to external sources. In some configurations, the algorithm can trigger the reverse mode based on manual input from the user. The algorithm controls backspin speed and/or torque when the PCP system 200 is operating in the reverse mode. During reverse mode, when the torque and/or discharge pressure of the PCP 210 reaches a predetermined setpoint (which may be stored in the memory and accessed by the controller 252), the algorithm causes the controller 252 to stop the pump 210 (e.g., by stopping or turning off the PMM 230, thereby causing rotation of the rotor 212 to stop) to avoid a pump-off or run dry condition. Additionally or alternatively, the pump 210 can be stopped and/or the reverse mode can be manually ended by an appropriate input from the user via one or more of the user interfaces 256.

Figure 9:
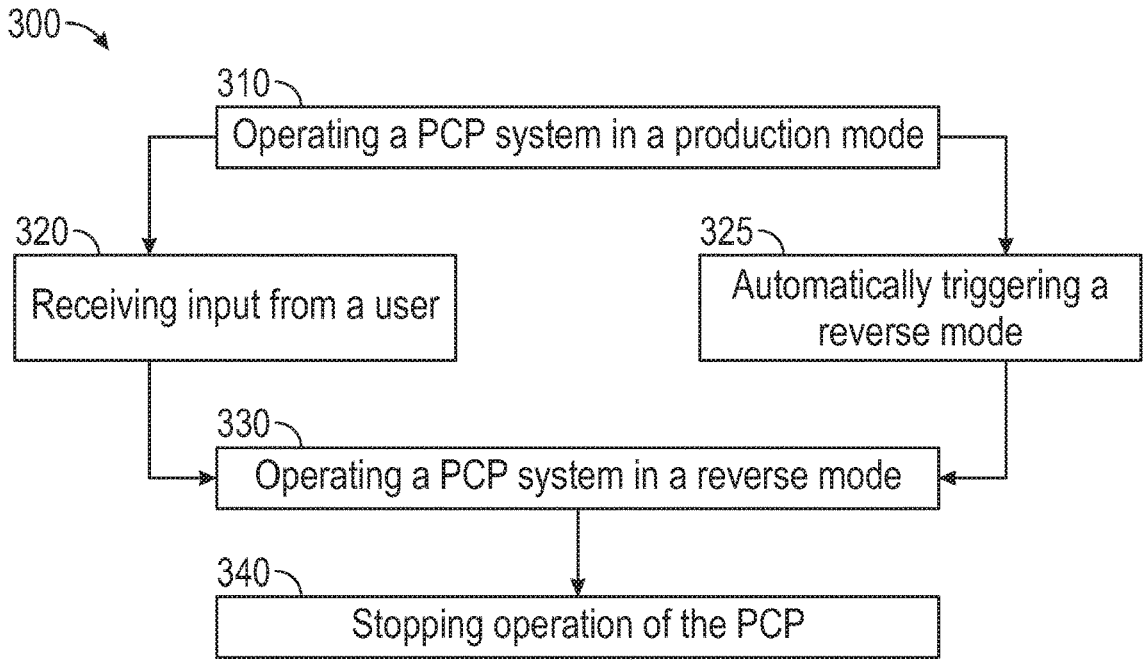
FIG. 9 illustrates a flow chart of an example method of operating a PCP system according to embodiments of the disclosure.

FIG. 9 illustrates a flow chart of an example method 300 of operating a PCP system, such as PCP system 200, according to embodiments of the present disclosure. As shown, the method 300 includes operating a PCP system 200 in a production mode, which includes rotating the rotor 212 of the PCP system 200 in a first (e.g., clockwise) direction, at step 310. The method 300 can include receiving input from a user at step 320. For example, the control system 250 can receive input from the user via any one or more of the user interfaces 256. Instead of or in addition to receiving input from the user, the method 300 can include automatically triggering a reverse mode at step 325. For example, the method can include a controller receiving data from one or more sensors, determining a pump shutdown is imminent based on the data, and automatically triggering the reverse mode in response to the determination that a pump shutdown is imminent. If so directed by the user input or based on automatic triggering, the method includes operating the PCP system 200 in a reverse mode, which includes rotating the rotor 212 in a second, opposite (e.g., counter clockwise) direction, at step 330. In the reverse mode, the PMM 230, sucker rods 220, and rotor 212 rotate backwards, e.g., counter clockwise, to pump well fluids and solid particles suspended therein back down in the wellbore. In some configurations, during operation of the PCP system 200 in the reverse mode at step 330, the method further includes controlling backspin speed and/or torque of the PCP system 200. The method 300 can further include stopping operation of the PCP, as shown in step 340.

Figure 10:
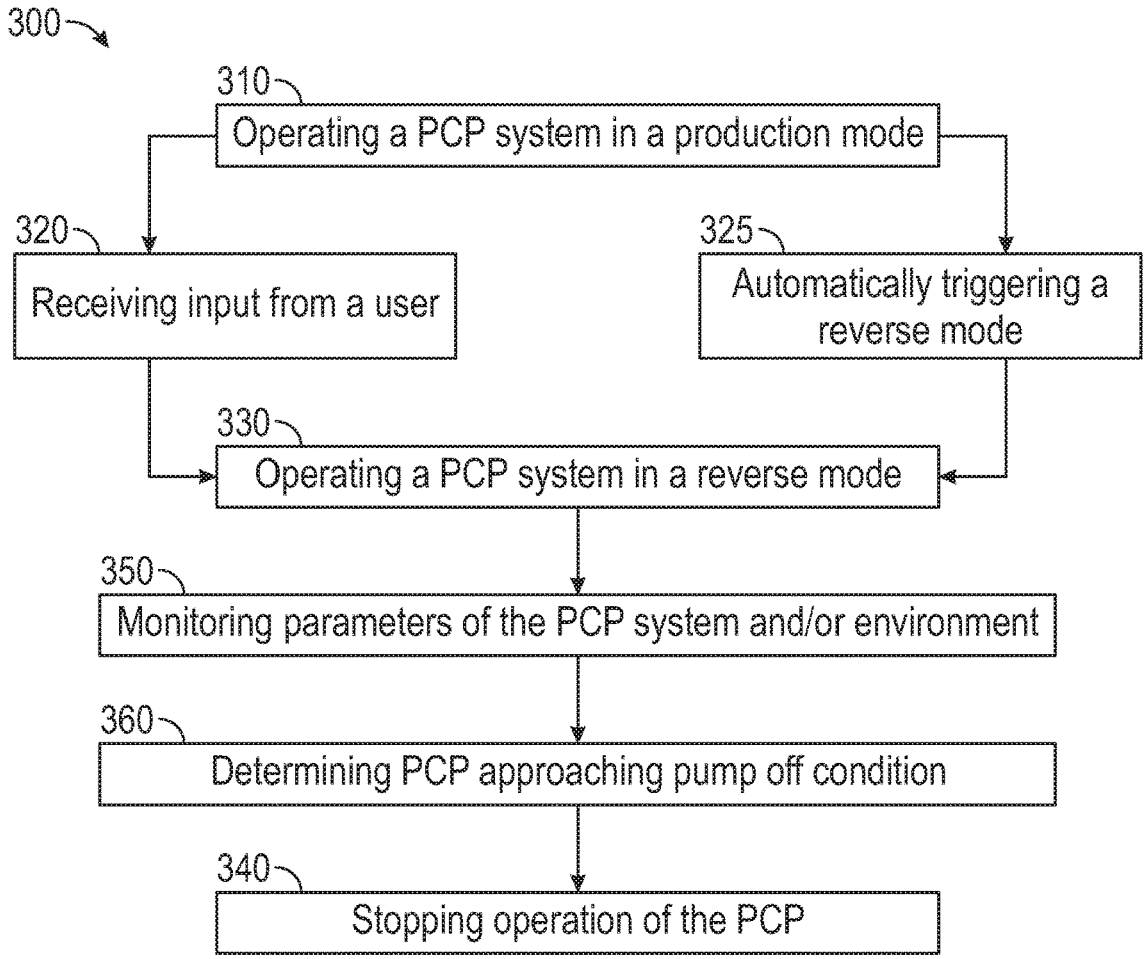
FIG. 10 illustrates a flow chart of another example method of operating a PCP system according to embodiments of the disclosure.

Step 340, stopping operation of the PCP, can be performed manually, for example, based on input provided by the user to one or more user interfaces 256. Additionally or alternatively, step 340 can be performed automatically. For example, as shown in step 350 of the variation of method 300 illustrated in the flow chart of FIG. 10, the method 300 can include monitoring parameters of the PCP system and/or environment, for example, via one or more sensors. In some configurations, monitoring parameters of the PCP system and/or environment includes monitoring speed, torque, and/or discharge pressure of the PCP. At step 360, the method 300 can further include determining that the PCP 210 is approaching a pump off or run dry condition, for example, based on the monitored parameters of step 350 and/or processing of the monitored parameters by the controller 252. In some configurations, the method 300 determines that the PCP 210 is approaching a pump off or run dry condition if the torque and/or discharge pressure of the PCP reaches a predetermined setpoint. Step 340, stopping operation of the PCP, can then be performed automatically based on a determination of approaching pump off or run dry at step 360.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A method of operating a progressive cavity pump (PCP) system, the system comprising a PCP disposed in a wellbore, the method comprising:

operating the PCP system in a production mode, wherein in the production mode a motor of the PCP system drives rotation of a sucker rod coupled to a rotor of the PCP to rotate the rotor in a first direction to pump a fluid from a reservoir in an uphole direction through the PCP; and performing a pump shutdown of the PCP system, wherein a column of the fluid is above the PCP and the pump shutdown comprises:

operating the PCP system in a reverse mode, wherein in the reverse mode the motor drives the rotation of the sucker rod coupled to the rotor to rotate the rotor in a second direction opposite the first direction to pump the column of the fluid in a downhole direction through the PCP;

monitoring a torque of the PCP; and stopping the rotation of the rotor of the PCP while operating in the reverse mode to shut down the PCP in response to determining the PCP is approaching a run dry condition to avoid the run dry condition, wherein determining the PCP is approaching the run dry condition includes determining the torque has reached a predetermined setpoint.

2. The method of claim 1, wherein the first direction is a clockwise direction.

3. The method of claim 1, wherein the second direction is a counter-clockwise direction.

4. The method of claim 1, wherein the reverse mode is configured to pump solid particles suspended in the column of the fluid down the wellbore prior to stopping the rotation of the rotor.

5. The method of claim 1, further comprising receiving an input from a user into a control system of the PCP system, wherein the input from the user includes an instruction to perform the pump shutdown, and wherein the PCP system is operated in the reverse mode in response to the input received from the user.

6. The method of claim 1, wherein the PCP system is operated in the reverse mode automatically in response to a control system of the PCP system determining the PCP system is shutting down.

7. A progressive cavity pump (PCP) system comprising:

a PCP comprising a rotor rotatably disposed within a hollow stator, the PCP configured to be disposed downhole in a borehole of a well;

a permanent magnet motor (PMM) configured to be disposed at a surface of the well;

a sucker rod coupled to the rotor of the PCP via a connection and operatively coupled to the PMM, wherein in use, the PMM drives rotation of the sucker rod to rotate the rotor; and a control system configured to control operation of the PCP system, the control system configured to:

operate the PCP system in a production mode, wherein in the production mode the PMM drives rotation of the sucker rod coupled to the rotor to rotate the rotor in a first direction to pump a fluid from a reservoir in an uphole direction through the PCP; and perform a pump shutdown of the PCP system, wherein a column of the fluid is above the PCP and the pump shutdown comprises:

operating the PCP system in a reverse mode, wherein in the reverse mode the PMM drives the rotation of the sucker rod coupled to the rotor to rotate the rotor in a second direction opposite the first direction to pump the column of the fluid in a downhole direction through the PCP;

monitoring a torque of the PCP; and stopping the rotation of the rotor of the PCP while operating in the reverse mode to shut down the PCP in response to determining the PCP is approaching a run dry condition to avoid the run dry condition, wherein determining the PCP is approaching the run dry condition includes determining torque has reached a predetermined setpoint.

8. The PCP system of claim 7, wherein the connection is configured to isolate axial forces on a junction of the sucker rod and the rotor from circumferential forces on the junction.

9. The PCP system of claim 7, wherein the connection comprises a tapered projection at a lower end of the sucker rod and a corresponding recess at an upper end of the rotor.

10. The PCP system of claim 7, the control system further configured to control backspin speed and torque when operating the PCP system in the reverse mode.

11. The PCP system of claim 7, the control system comprising one or more user interfaces configured to receive input from a user.

12. The PCP system of claim 7, further comprising one or more sensors configured to monitor one or more parameters of the PCP system and/or the well.

13. A control system for a progressive cavity pump (PCP) system including a PCP, the control system comprising:

a display screen;

one or more user interfaces; and a processor configured to:

operate the PCP system in a production mode, wherein in the production mode a motor of the PCP system drives rotation of a sucker rod coupled to a rotor of the PCP to rotate the rotor in a first direction to pump a fluid from a reservoir in an uphole direction through the PCP disposed in a wellbore; and perform a pump shutdown of the PCP system, wherein a column of the fluid is above the PCP and the pump shutdown comprises:

operating the PCP system in a reverse mode, wherein in the reverse mode the motor drives the rotation of the sucker rod coupled to the rotor to rotate the rotor in a second direction opposite the first direction to pump the column of the fluid in a downhole direction through the PCP;

monitoring if a torque of the PCP reaches a predetermined setpoint; and stopping the rotation of the rotor of the PCP while operating in the reverse mode to shut down the PCP in response to determining the PCP is approaching a run dry condition to avoid the run dry condition, wherein determining the PCP is approaching the run dry condition includes determining the torque of the PCP has reached the predetermined setpoint.

14. The control system of claim 13, wherein the processor is further configured to control backspin speed and torque when operating the PCP system in the reverse mode.

* * * * *